United States Patent [19]

Shen

[11] Patent Number: 4,725,086

[45] Date of Patent: Feb. 16, 1988

[54] ADJUSTABLE BOLT FOR TUBULAR LOCKSETS

[76] Inventor: Chao C. Shen, No. 62, Ho Shan Street, Tainan City, Taiwan

[21] Appl. No.: 938,846

[22] Filed: Dec. 8, 1986

[51] Int. Cl.[4] ..... E05C 1/16

[52] U.S. Cl. ..... 292/337; 292/DIG. 60

[58] Field of Search ..... 292/DIG. 60, 1, 337, 292/169.13, 169.14, 169.15

[56] References Cited

U.S. PATENT DOCUMENTS 1,661,454 3/1928 Wilson ..... 292/337 X 4,602,490 7/1986 Glass et al. ..... 292/337 X 4,623,174 11/1986 Trull et al. ..... 292/1

*Primary Examiner*—Richard E. Moore

*Attorney, Agent, or Firm*—Bacon & Thomas

[57] ABSTRACT

An adjustable bolt for deadbolt locksets which has a moveable catch to be inserted into a first indicator hole or a second indicator hole and a plunger pin to be inserted into a first slot or second slot of an adjustable slot. When the moveable catch and plunger pin are set at the first position, the lockset can be used for 70 mm backset. When the moveable catch and plunger pin link are set at the second position, the lockset is used for 60 mm backset.

2 Claims, 7 Drawing Figures

ADJUSTABLE BOLT FOR TUBULAR LOCKSETS

BACKGROUND OF THE INVENTION

The present invention relates to an adjustable bolt for deadbolt locksets which are installed on the door, such bolt being suitable for 60 mm and 70 mm (2⅜" and 2¾") backsets (the backset is the length from the center of the bored hole to door edge).

At present, there are two commonly used standard backset lengths, namely 60 mm and 70 mm. This means that if a conventional lockset is designed to a 60 mm backset then it could never be properly installed in a door in which the backset is 70 mm. For this reason, manufacturers currently make two different lengths of bolts to meet the different backset size needs, which often causes confusion or inconvenience when installing or replacing; however, the structure of such bolts for these installations is substantially the same for both lengths. Therefore, to manufacture two different types of bolts merely for different backset needs is troublesome. Furthermore, the cost of manufacturing two types of bolts increases manufacturing costs.

It is the purpose of this present invention, therefore, to mitigate and/or obviate the abovementioned drawbacks in the manner set forth in the detailed description of the preferred embodiment.

SUMMARY OF THE INVENTION

It is a primary objective of the present invention to provide an adjustable bolt for deadbolt locksets which can be adapted to either 60 mm or 70 mm backsets.

It is another objective of the present invention to provide an adjustable bolt of deadbolt locksets which can significantly reduce production costs.

It is still another objective of the present invention to provide an adjustable bolt for deadbolt locksets which is easy to fabricate and practical for use.

Further objectives and advantages of the present invention will become apparent as the following description proceeds, and the features of novelty which characterized the invention are pointed out with particularity in the claims annexed to and forming a part of this invention.

DETAILED DESCRIPTION OF THE PREFERRED EMBODIMENT

Figure 1:
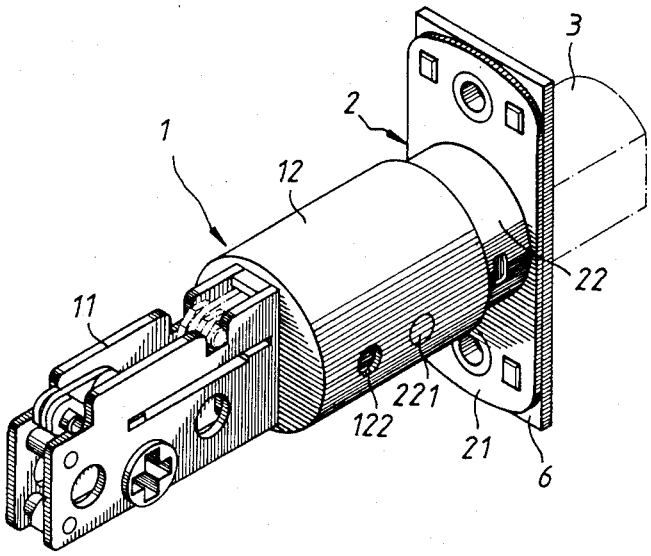
FIG. 1 is a perspective view of a preferred embodiment of the present invention.
Figure 2:
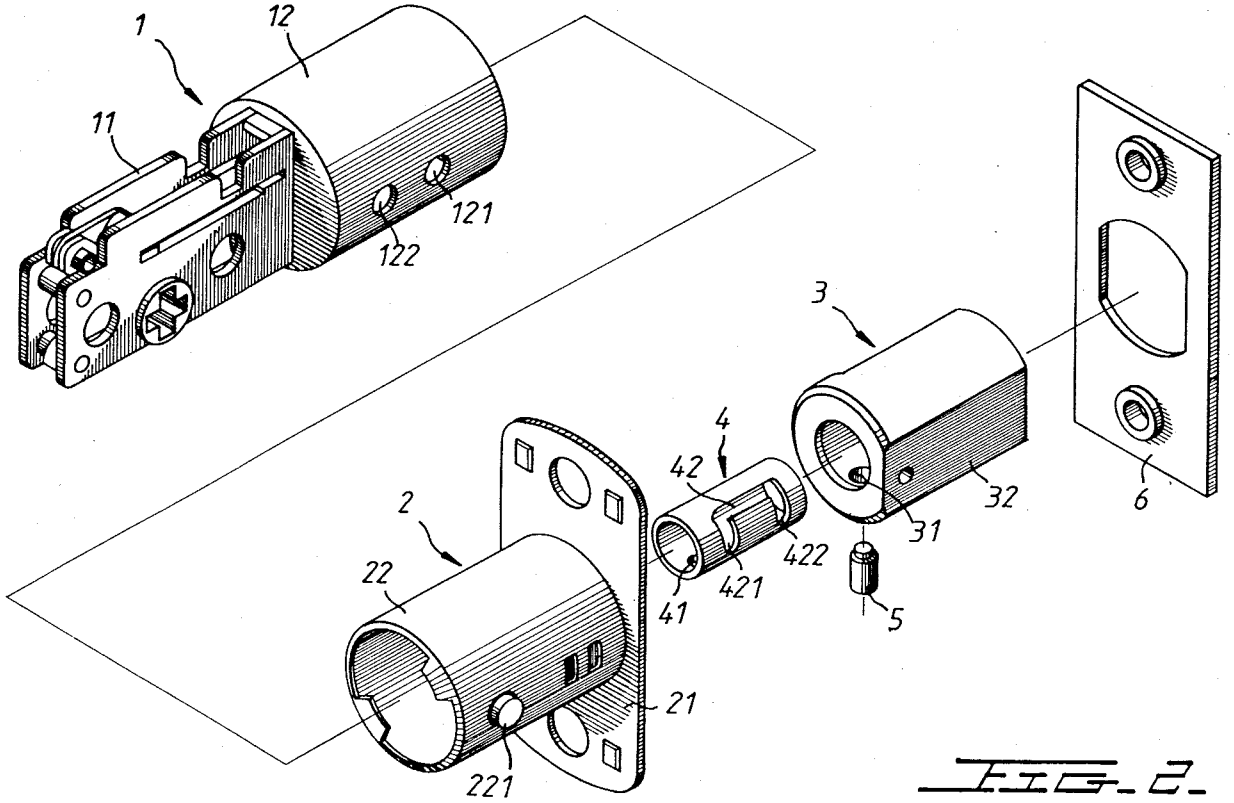
FIG. 2 is an exploded view of the present invention.
Figure 3:
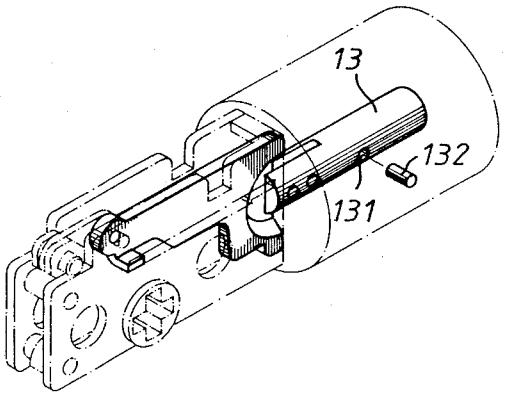
FIG. 3 is a perspective view of the transmission means showing its plunger with a plunger pin being disengaged.

Referring to the drawings and particular to FIGS. 2 and 3, a transmission means (1) comprises a backset plate base (11) and an housing (12) which are similar to conventional transmission means except that the housing (12) has first and second indicator holes (121) and (122). Within the housing (12), there is a plunger (13) which is connected with the backset plate (11) at one end and which has a plunger pin (132) which inserts into an aperture (131) thereon.

A guide means (2) comprises a guide plate (21) which has a central hole (not shown in the drawing) and an inside tube (22) which has a moveable catch (221) disposed through the outer surface. The inside tube (22) is disposed into the outer housing (12) and the moveable catch (221) is selectively inserted into the first indicator hole (121) or second indicator hole (122) of the housing (12), thereby engaging the inside tube and housing (12 and 22).

A latch bolt (3) allows an adjustable roller (4) to be inserted therein. A set pin (5) is inserted through apertures (31 and 41) of the latch bolt (3) and adjustable roller) (4) so that the latch bolt (3) and adjustable roller (4) are engaged together. The adjustable roller (4) further comprises an adjustable slot (42). The adjustable slot (42) includes a first slot (421) and a second slot (422) at its two ends to receive the plunger pin (132) of the plunger (13). Thus, the and adjustable roller and latch bolt (4 and 3) are inserted into the inside tube (22). Since two sides (32) of the latch bolt (3) are planar, the latch bolt (3) is unmoveable after it is inserted into the inside tube (22). After the latch bolt (3) and adjustable roller (4) are inserted into the housing, a face plate (6) is engaged on the guide plate (21) and the lockset of the present invention is completely fabricated.

Figure 4:
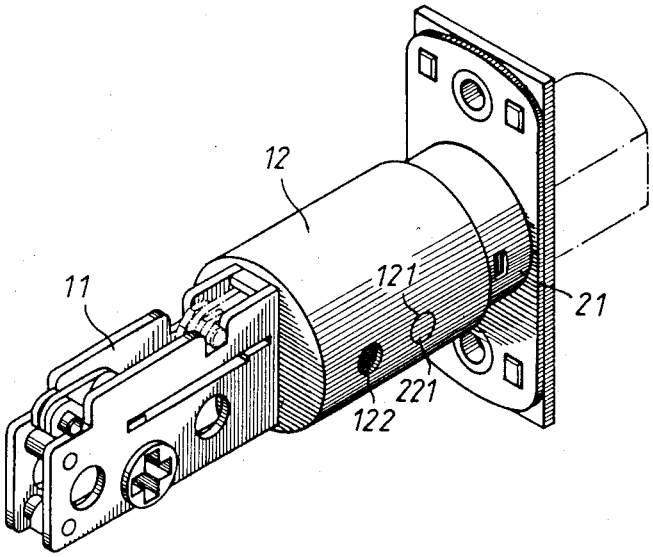
FIG. 4 shows the moveable catch engaged in the first indicator hole so that the adjustable bolt is suitable for 70 mm backset.
Figure 5:
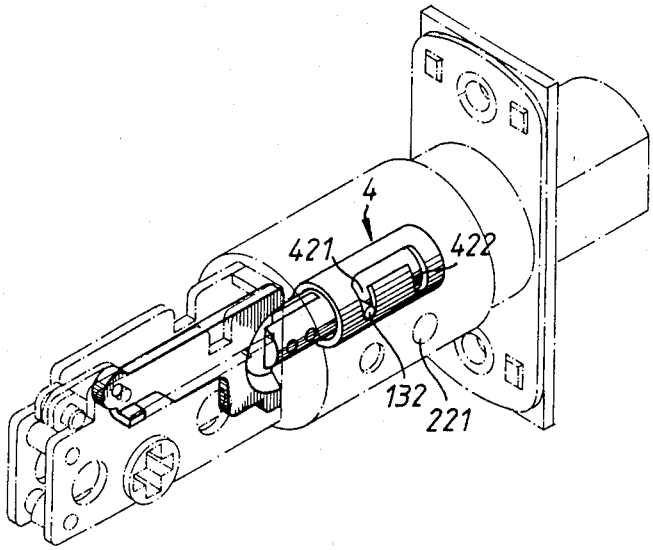
FIG. 5 shows the plunger pin inserted through the first slot so as to be used for 70 mm backset.
Figure 6:
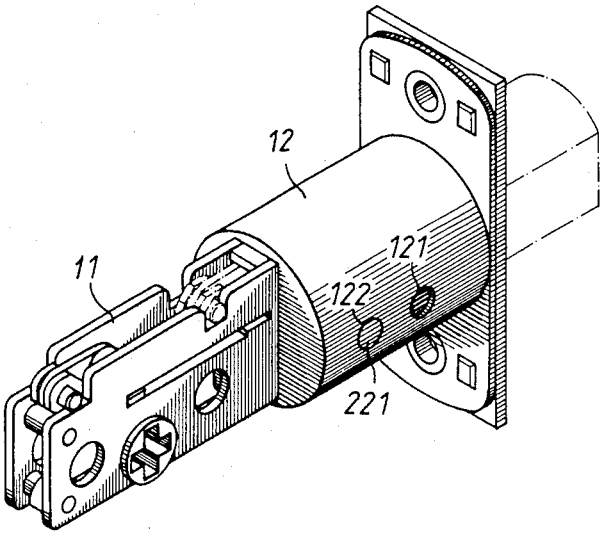
FIG. 6 shows the moveable catch engaged in the second indicator hole so that the adjustable bolt is suitable for 60 mm backset.
Figure 7:
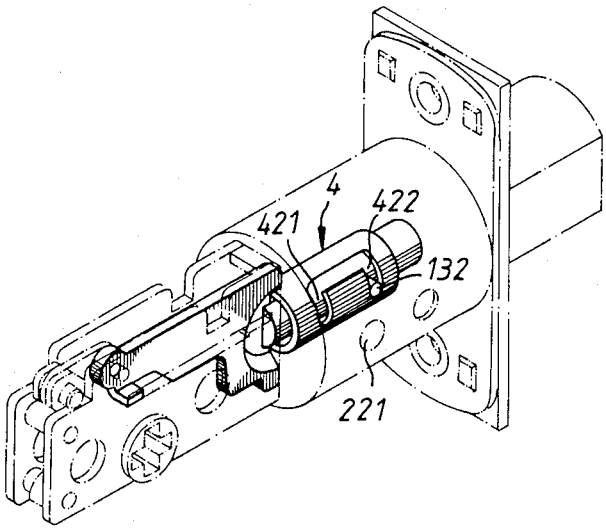
FIG. 7 shows the plunger pin inserted in the second slot so as to be used for 60 mm backset.

Referring to FIGS. 4 and 5, when the moveable catch (221) is inserted into the first indicator hole (121) and the plunger pin (132) is inserted into the first slot (421), then the assembly is used for 70 mm backset. Further, the user can press the moveable catch (221) down and rotate the transmission means (1) counterclockwise and then push the transmission means (1) forward. That is, when the plunger pin (132) and the indicator holes (121) and (122) are moved forward, as shown in FIGS. 6 and 7, the plunger pin (132) can be inserted into the second slot (422) and the moveable catch (221) can be inserted the second indicator hole (122) after the transmission means (1) is rotated clockwise so as to be used for 60 mm backset.

As various possible embodiments might be made of the above invention without departing from the scope of the invention, it is to be understood that all matter herein described or shown in the accompanying drawings is to be interpreted as illustrative and not in a limiting sense. Thus it will be appreciated that the drawings are exemplary of a preferred embodiment of the invention.

I claim:

1. An adjustable bolt assembly for a deadbolt lockset comprising:

(a) a transmission means including a backset plate, a housing carried by the backset plate, the housing including first and second holes for indicating different first and second backset distances, a plunger extending from the backset plate and disposed within the housing, the plunger including an aperture and a plunger pin inserted within the aperture;

(b) a guide means including a guide plate, an inside tube carried by the guide plate, a catch extending from the outer surface of the inside tube, the inside tube being disposed within the housing, whereby the catch may be selectively insertable through either of the first and second holes of the housing for setting a desired backset distance;

(c) an adjustable roller slidably received on the plunger, the adjustable roller including a roller aperture and a slot means configured to provide first and second adjustment positions, the plunger pin being disposed within the slot means for selective engagement in either of the first and second adjustment positions;

(d) a latch bolt of substantially cylindrical configuration and provided with at least one longitudinal planar surface and a bolt aperture disposed adjacent one end of the planar surface;

(e) a set pin inserted through the bolt aperture and roller aperture for engaging the latch bolt and adjustable roller together, the engaged latch bolt and adjustable roller being disposed within the inside tube;

(f) a face plate engaged on the guide plate, the face late including an aperture through which the latch bolt is inserted; and (g) whereby the adjustable bolt assembly is disposed for use at the first backset distance when the catch is inserted through the first hole and the plunger pin is engaged in the first adjustment position, and the bolt assembly is disposed at the second backset distance when the catch is inserted through the second hole and the plunger pin is engaged in the second adjustment position.

2. The adjustable bolt assembly of claim 1 wherein the first backset distance is 70 mm and the second backset distance is 60 mm.

* * * * *